US005567125A

United States Patent [19]

Noah et al.

[11] Patent Number: 5,567,125

[45] Date of Patent: Oct. 22, 1996

[54] PUMP ASSEMBLY WITH TUBULAR BYPASS LINER WITH AT LEAST ONE PROJECTION

[75] Inventors: Bruce C. Noah, W. Lafayette; Robert S. Phillips; Frederick D. Venable, both of Lafayette, all of Ind.

[73] Assignee: TRW Inc., Lyndhurst, Ohio

[21] Appl. No.: 369,369

[22] Filed: Jan. 6, 1995

[51] Int. Cl.[6] ..... F04B 49/00

[52] U.S. Cl. ..... 417/310; 417/300; 285/55

[58] Field of Search ..... 417/310, 298, 417/300, 440; 285/45, 55; 29/888.02, 888.025, 451

[56] References Cited

U.S. PATENT DOCUMENTS

| | | | |
|---|---|---|---|
| 1,096,619 | 5/1914 | Gage | 29/888.02 |
| 1,871,883 | 8/1932 | Geyer | 285/45 |
| 2,724,335 | 11/1955 | Eames | 417/310 |
| 2,813,488 | 11/1957 | Deska . | |
| 3,606,659 | 9/1971 | Robbins | 285/55 |
| 3,738,228 | 6/1973 | Harrison | 417/291 |
| 3,822,965 | 7/1974 | Drutchas et al. | 417/310 |
| 3,828,415 | 8/1974 | Kammeraad et al. | 29/451 |
| 4,026,583 | 5/1977 | Gottlieb | 285/55 |
| 4,553,908 | 11/1985 | Merz . | |
| 4,564,338 | 1/1986 | Ilg . | |
| 4,575,314 | 3/1986 | Teubler et al. . | |
| 5,267,840 | 12/1993 | Snow et al. | 417/310 |

FOREIGN PATENT DOCUMENTS

| | | | |
|---|---|---|---|
| 4237483 | 5/1994 | Germany | 417/300 |

*Primary Examiner*—Timothy S. Thorpe
*Assistant Examiner*—Ted Kim
*Attorney, Agent, or Firm*—Tarolli, Sundheim, Covell, Tummino & Szabo

[57] ABSTRACT

A pump assembly (20) includes a rotor (40) and a stator (38) which are disposed within a housing (24) and partially define pumping chambers (56). Fluid is conducted through an inlet passage (104) to an inlet cavity (58) which is connected with the pumping chambers (56). Fluid is conducted from the pumping chambers (56) to an outlet (62) from the pump assembly (20). A tubular passage liner (112) is disposed in the inlet passage (104) and has a straight passage (138) through which fluid flow is conducted to the inlet cavity (58). The tubular passage liner (112) prevents erosion of the housing (24) during conduction through the inlet passage (104) of inlet fluid and fluid bypassed from the outlet (62) of the pump assembly (20). Projections (204 and 206) at one end of the tubular passage liner (112) are engageable with the stator (38) to limit movement of the tubular passage liner relative to the stator. The tubular passage liner (112) is installed in the inlet passage (104) by first closing a slot (180) to reduce the cross-sectional size of the tubular passage liner. The tubular passage liner (112) is then inserted into the inlet passage (104). The slot (180) is then opened to increase the size of the tubular passage liner (112).

8 Claims, 4 Drawing Sheets

PUMP ASSEMBLY WITH TUBULAR BYPASS LINER WITH AT LEAST ONE PROJECTION

BACKGROUND OF THE INVENTION

The present invention relates,to a new and improved pump assembly and more specifically to a pump assembly in which excess fluid is bypassed from an outlet to an inlet passage.

During operation of a pump assembly, it is a common practice to bypass fluid at a relatively high pressure from an outlet to an inlet passage. As the bypassed fluid enters and flows along the inlet passage, the pressure in the bypassed fluid is quickly reduced. Thus, the pressure in the bypassed fluid may be reduced from more than 2,000 psi (gauge) to less than 100 psi (gauge).

This rapid pressure reduction in the bypassed fluid tends to cause localized cavitation in the fluid. The bypassed fluid is concentrated in a stream which may impact against the side of the inlet fluid passage. The combined effects of impacting of the stream of bypassed fluid against the housing and cavitation in the bypassed fluid tends to erode the housing.

SUMMARY OF THE INVENTION

An improved pump assembly includes a rotor and a stator which are enclosed by a housing. A straight tubular passage liner is provided in an inlet passage to protect the housing against erosion by a combined flow of relatively high pressure bypassed fluid and inlet fluid. Projections are provided at an end of the tubular passage liner to engage the stator and limit movement of the tubular passage liner if the flow of fluid through the tubular passage liner tends to move the liner relative to the housing.

The tubular passage liner may be installed in an inlet passage by reducing the cross-sectional size of the tubular passage liner. Once the cross-sectional size of the tubular passage liner has been reduced, it is inserted into the inlet passage. The cross-sectional size of the tubular passage liner is then increased so that the tubular passage liner grips an inner side surface of the inlet passage.

BRIEF DESCRIPTION OF THE DRAWINGS

The foregoing and other features of the present invention will become more apparent upon a consideration of the following description taken in connection with the accompanying drawings wherein.

DESCRIPTION OF ONE SPECIFIC PREFERRED EMBODIMENT OF THE INVENTION

General Description

Figure 1:
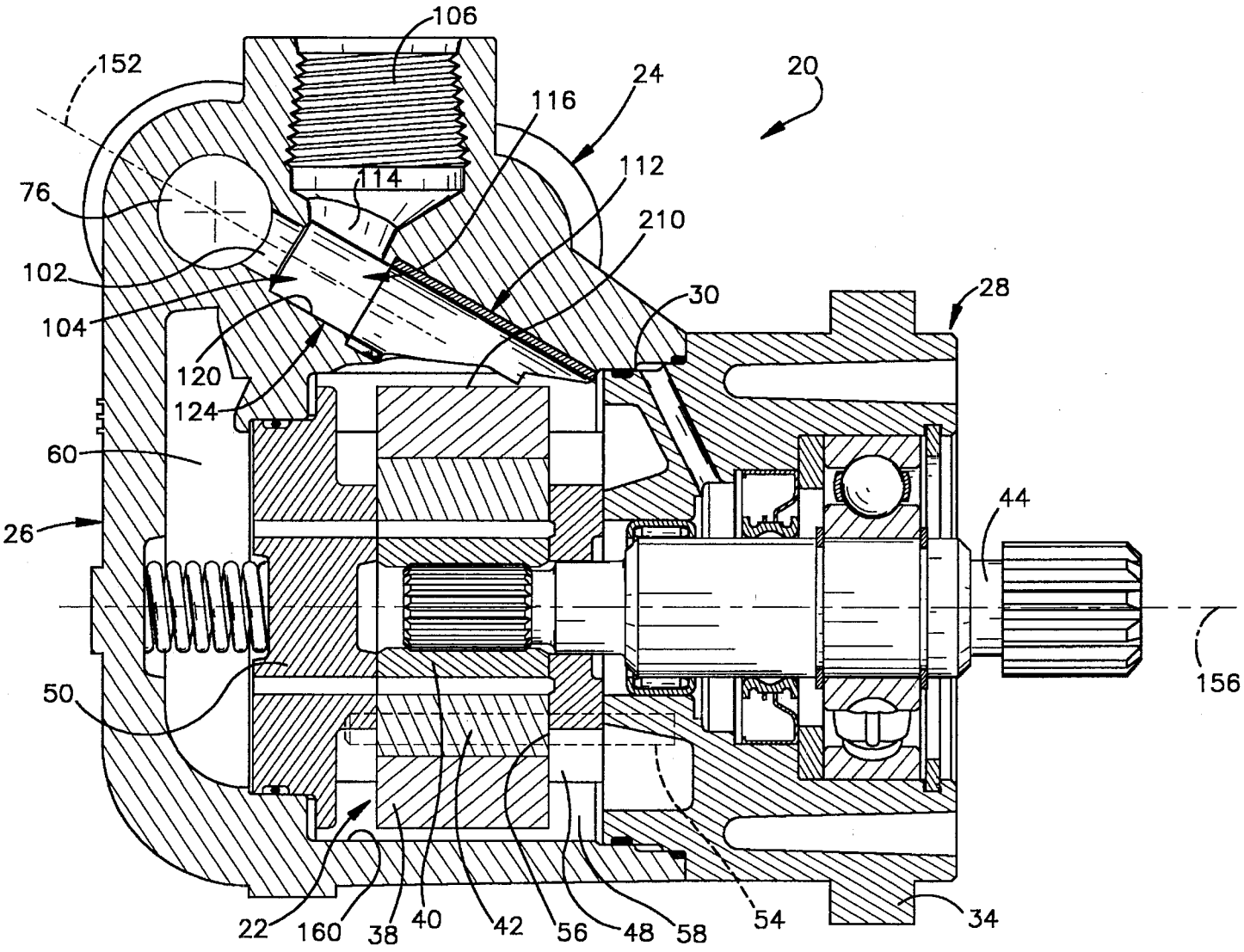
FIG. 1 is a sectional view of a pump assembly constructed in accordance with the present invention.

A pump assembly 20 (FIG. 1) is used to pump hydraulic fluid. The pump assembly 20 is suitable for use as a power steering pump in a vehicle. However, it should be understood that the pump assembly 20 could be used to pump hydraulic fluid in other environments.

The pump assembly 20 includes a working unit 22 which is enclosed by a housing 24. The housing 24 includes a main section 26 and a cover section 28. The cover section 28 telescopically engages the main section 26 at a joint 30.

The main section 26 of the housing 24 is a one-piece aluminum casting. Similarly, the cover section 28 is a one-piece aluminum casting. The main section 26 is connected to the cover section 28 by suitable retainer bolts. A mounting flange 34 on the cover section 28 is used to connect the pump 20 with a suitable support structure.

The working unit 22 (FIG. 1) is enclosed by the housing 24. The working unit 22 includes a cylindrical cam ring or stator 38 which extends around a rotor 40. A plurality of vanes 42 extend between the cam ring or stator 38 and the rotor 40. A drive shaft 44 is connected with the rotor 40 and is rotatable to rotate the rotor and vanes 42 relative to the stationary cam ring 38.

A bottom or wear end plate 48 is connected with the cover section 28 and engages the right (as viewed in FIG. 1) ends of the rotor 40 and cam ring 38. A top or pressure end plate 50 engages the axially opposite ends of the cam ring 38 and rotor 40. The cam ring 38, bottom or wear end plate 48, and top or pressure end plate 50 are connected to the cover section 28 by alignment pins 54. The vanes 42 cooperate with the cam ring 38, rotor 40, and end plates 48 and 50 to form variable volume pumping chambers 56.

Although only one alignment pin 54 is illustrated in FIG. 1, it should be understood that a pair of alignment pins engage the cam ring 38, bottom or wear end plate 48 and top or pressure end plate 50 to hold them against movement relative to the cover section 28. The cam ring 38, rotor 40, vanes 42, bottom or wear end plate 48, and top or pressure end plate 50 are connected with the cover section 28 by a pair of alignment pins in the same manner and have the same construction as is disclosed in copending U.S. patent application Ser. No. 08/194,410 filed Feb. 10, 1994 by Bruce Co Noah and entitled "Rotary Device and Method of Assembly". However, the cam ring 38, rotor 40, vanes 42, bottom or wear end plate 48 and top or pressure end plate 50 may be connected with the cover section 28 and may be constructed in any desired manner.

During rotation of the drive shaft 44 and rotor 40 relative to the stationary cam ring or stator 38, the vanes 42 cooperate with the cam ring and vary the volume of the pumping chambers 56. Hydraulic fluid is conducted from a cylindrical inlet chamber 58 to the pumping chambers 56. Fluid is pumped from the pumping chambers 56 to a discharge chamber 60 disposed between the top or pressure end plate 50 and the main section 26 of the housing 24. The discharge chamber 60 is connected with an outlet 62 (FIG. 2) through an outlet passage 64 and a bypass valve assembly 66. Relatively high pressure fluid is conducted away from the outlet 62 and the pump assembly 20 through a discharge conduit (not shown).

The bypass valve assembly 66 (FIG. 2) is disposed in a generally cylindrical bypass valve chamber 76. The bypass valve assembly 66 includes a bypass valve member 80 which is axially movable in the bypass valve chamber 76. A pressure relief valve 82 is mounted on the bypass valve member 80. A stationary orifice plug 84 is provided in the main section 26 of the housing adjacent to the right (as viewed in FIG. 2) end of the bypass valve member 80. Fluid discharged from the working unit 22 (FIG. 1) is conducted through a cylindrical orifice 86 (FIG. 2) in the orifice plug 84 to a discharge conduit (not shown).

A radially extending passage 92 (FIG. 2) in the orifice plug 84 conducts fluid pressure from the orifice 86 to a passage 94 formed in the main section 26 of the housing 24. The passage 94 is connected in fluid communication with a pressure chamber 96 at the left (as viewed in FIG. 2) end of the bypass valve member 80. The fluid pressure in the pressure chamber 96 and a coil spring 98 urge the bypass valve member 80 toward the initial position shown in FIG. 2.

Figure 2:
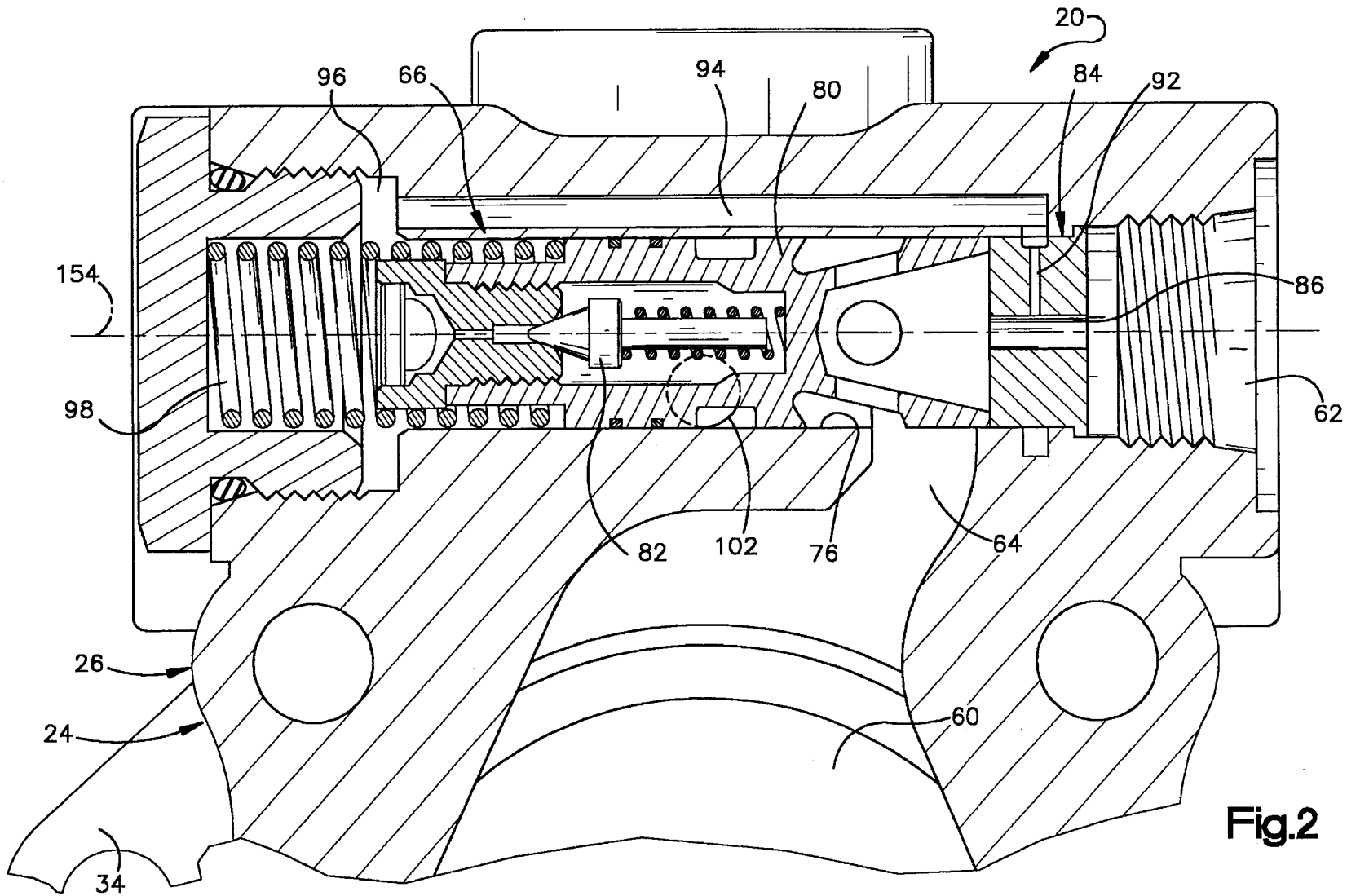
FIG. 2 is an enlarged sectional view illustrating the construction of a bypass valve assembly used in the pump assembly of FIG. 1.

When the fluid pressure at the outlet passage 64 exceeds the combined influence of the fluid pressure in the chamber 96 and the coil spring 98, the bypass valve member 80 is moved toward the left (as viewed in FIG. 2) to connect the outlet passage 64 with a bypass passage 102 (FIGS. 1 and 2). The fluid from the bypass passage 102 is conducted to an inlet passage 104 (FIG. 1). The relatively high pressure fluid bypassed from the outlet 64 to the bypass passage 102 is used to promote a flow of fluid into the inlet passage 104 from an inlet 106 to the housing 24. The inlet 106 is connected with a source (not shown) of fluid at a low pressure (atmospheric).

Tubular Passage Liner

In accordance with one of the features of the present invention, a tubular passage liner 112 (FIG. 1) is provided in the inlet passage 104. The tubular passage liner 112 protects the main section 26 of the housing 24 against erosion by the combined flow of the inlet fluid and the bypassed fluid. During operation of the pump 20, inlet fluid, at a relatively low pressure, is conducted from the inlet 106 into an initial or inlet section 114 (FIG. 3) of the inlet passage 104. The inlet fluid flows from the initial section 114 of the inlet passage 104 into a main section 116 of the inlet passage.

Hydraulic fluid bypassed by the bypass valve assembly 66 (FIG. 2) is conducted from the bypass valve chamber 76 through the bypass passage 102 (FIG. 3) into the main section 116 of the inlet passage 104. The bypassed hydraulic fluid is at a relatively high pressure. Thus, in one specific embodiment of the pump 20, the bypassed hydraulic fluid was at a pressure in excess of 2,000 psi (gauge). When the bypassed hydraulic fluid enters the inlet passage 104, it aspirates inlet hydraulic fluid through the initial section 114 of the inlet passage 104 into the main section 116 of the inlet passage in a well-known manner. As this occurs, the pressure in the bypassed hydraulic fluid decreases rapidly to a relatively low pressure. In the specific embodiment of the pump 20 previously referred to, the bypassed hydraulic fluid pressure dropped to less than 100 psi (gauge).

The rapid decrease in the bypassed fluid pressure tends to cause localized cavitation in the bypassed fluid. The bypassed fluid is introduced into the main section 116 of the inlet passage 104 in a tight stream. The combined effects of cavitation in the bypassed fluid and the stream of bypass fluid tends to erode the relatively soft aluminum which forms the main section 26 of the housing 24.

In accordance with one of the features of the present invention, the tubular passage liner 112 is provided in the inlet passage 104 to protect the main section 26 of the housing 24 against erosion. The tubular passage liner 112 is formed of a relatively hard metal which cannot be readily eroded during the combined flow of inlet fluid and bypassed fluid through the tubular passage liner 112.

As a result of experimentation, it has been determined that the combined inlet and bypass fluid flow does not tend to erode the pump housing 24 until after the combined flows have moved downstream from a location where the bypassed fluid enters the inlet passage 104. The reason why erosion does not occur in the portion of the inlet passage 104 where the bypassed fluid enters the inlet passage is not known for certain. However, it is theorized that the tight stream of bypass fluid is maintained in a spaced apart relationship with a cylindrical inner side surface 120 of the inlet passage 104 until the stream of bypassed fluid has moved downstream from the location where it is initially introduced into the inlet passage and has had an opportunity to expand.

As the stream of bypassed fluid expands in the inlet passage 104, the fluid pressure in the stream drops rapidly. It is theorized that the fluid pressure drops below the vaporization pressure of the hydraulic fluid. As this occurs, the resulting cavitation in the fluid conducted through the inlet passage 104 tends to cause erosion of the material forming the inlet passage. By providing the tubular liner 112 which is formed of a relatively hard metal, erosion of the soft aluminum of the main section 26 of the housing 24 is prevented.

The main section 116 of the inlet passage 104 includes a cylindrical unlined section 124 (FIG. 3) and a cylindrical lined section 126. The diameter of the lined section 126 of the inlet passage 104 exceeds the diameter of the unlined section 124 of the inlet passage 104 by an amount which is equal to twice the radial thickness of the tubular passage liner 112. By experimentation, it has been determined that the combined flow of bypass fluid and inlet fluid does not cause erosion of the unlined section 124 of the main section 116 of the inlet passage 104. However, in the absence of the tubular passage liner 112, the combined flow of bypassed fluid and inlet fluid through the lined section 126 would cause erosion of the soft aluminum forming the housing 24.

The tubular passage liner 112 (FIGS. 3 and 4) has a circular inlet 130 which is upstream from a location where erosion of the housing 24 (FIG. 3) occurs in the absence of the tubular passage liner 112. The tubular passage liner 112 extends downstream from the inlet 130 to an outlet 134 to the inlet cavity 58. The tubular passage liner 112 has a straight cylindrical passage 138 which has the same diameter as the cylindrical side surface 120 of the unlined section 124 of the main section 116 of the inlet passage 104.

The tubular passage liner 112 has a cylindrical outer side surface 142 which engages and presses against a cylindrical surface 144 (FIG. 3) of the lined section 126 of the inlet passage 104. The cylindrical surface 144 of the lined section 126 of the inlet passage 104 is coaxial with the cylindrical side surface 120 of the unlined section 124 of the inlet passage 104. However, the diameter of the cylindrical surface 144 of the lined section 126 of the inlet passage 104 exceeds the diameter of the cylindrical surface 120 of the unlined section 124 of the inlet passage by an amount which is equal to twice the radial thickness of the tubular passage liner 112. The cylindrical surfaces 120 and 144 of the inlet passage 104 are coaxial with a cylindrical surface 148 of the bypass passage 102.

In one specific embodiment of the invention, the cylindrical surface 148 (FIG. 3) of the bypass passage 102 was formed by a drilling of 0.400 inches in the main section 26 of the housing 24. A second drilling of 0.500 inches forms the unlined section 124 of the inlet passage 104. The second drilling is concentric with the drilling forming the cylindrical side surface 148 of the bypass passage 102. A third drilling of 0.625 inches forms the lined section 126 of the inlet passage 104. The third drilling is concentric with the first two drillings and forms the cylindrical surface 144 of the inlet passage 104.

It should be understood that the foregoing specific dimensions for the coaxial cylindrical surfaces of the inlet passage 104 and bypass passage 102 have been set forth herein for purposes of clarity of description and not for purposes of limitation of the invention. It is contemplated that the bypass passage 102 and inlet passage 104 could be formed with cylindrical surfaces having diameters different from the specific diameters set forth above.

The bypass passage 102 and inlet passage 104 have a common central axis 152 (FIG. 3) which intersects and is a central axis 154 (FIG. 2) of the bypass valve chamber 76. The central axis 152 (FIG. 3) of the bypass passage 102 and inlet passage 104 is skewed at an acute angle of approximately 34° to a longitudinal central axis 156 (FIG. 1) of the pump 20 and the cylindrical inlet cavity 58. If desired, the angle between the axes 152 and 156 could be different than the specific angle set forth above.

The rotor 40 (FIG. 1) is rotatable about the central axis 156 of the pump 20 and the cylindrical inlet cavity 58. The longitudinal central axis 152 of the bypass passage 102 and inlet passage 104 is offset to one side of the central axis 156 of the pump 20. The cylindrical surface 144 (FIG. 3) of the lined section 126 of the inlet passage 104 intersects a cylindrical side surface 160 of the inlet cavity 58 at an elliptical opening in the side surface 160 of the cylindrical inlet cavity 58.

The tubular passage liner 112 (FIGS. 3 and 4) has a cylindrical inner side surface 166 which is coaxial with the central axis 152 of the inlet passage 104 (FIG. 3) and bypass passage 102. The cylindrical inner side surface 166 of the tubular passage liner 112 has an inside diameter which is the same as the diameter of the cylindrical side surface 120 of the unlined section 124 of the inlet passage 104. The cylindrical inner side surface 166 of the tubular passage liner 112 extends between the circular inlet 130 and the elliptical outlet 134 of the tubular passage liner 112. The elliptical outlet 134 from the tubular passage liner 112 has the same configuration as an elliptical intersection between the cylindrical surface 144 of the lined section 126 of the inlet passage 104 and the cylindrical side surface 160 of the inlet cavity 58.

Figure 4:
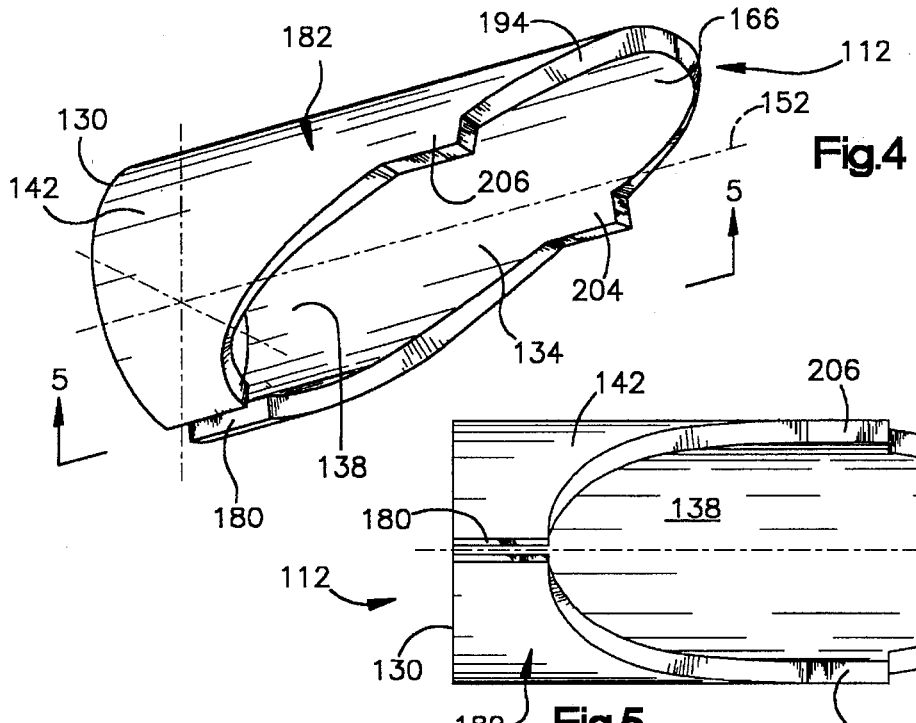
FIG. 4 is a pictorial illustration of a tubular passage liner used in a housing of the pump assembly of FIG. 1.
Figure 5:
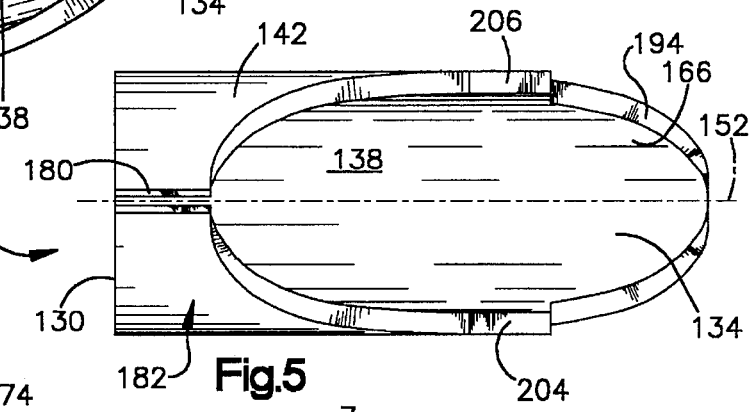
FIG. 5 is a plan view, taken generally along the line 5—5 of FIG. 4, further illustrating the tubular passage liner.
Figure 6:
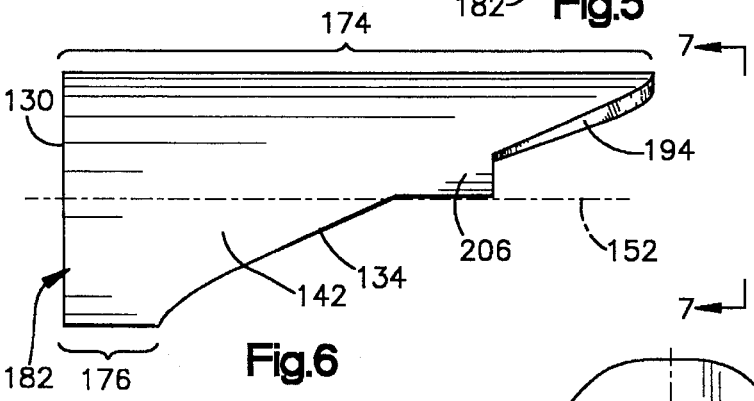
FIG. 6 is a side elevational view, further illustrating the tubular passage liner of FIG. 4.
Figure 7:
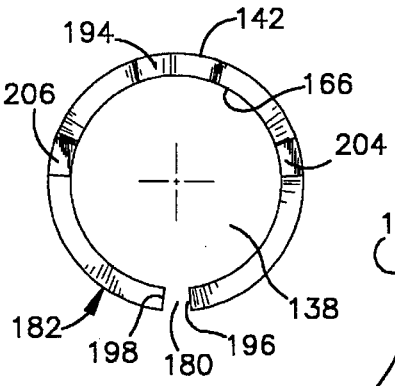
FIG. 7 is an end view, taken generally along the line 7—7 of FIG. 6, further illustrating the tubular passage liner.

The tubular passage liner 112 has a long side portion 174 (FIG. 6) which is diametrically opposite from a short side portion 176 of the tubular passage liner. A slot 180 (FIGS. 4, 5 and 7) is formed in the short side portion 176 (FIG. 6) of the tubular passage liner 112. The slot 180 (FIGS. 5 and 7) extends radially through a cylindrical side wall 182 of the tubular passage liner 112. The slot 180 has a longitudinal central axis which extends parallel to the longitudinal central axis 152 (FIG. 5) of the tubular passage liner 112. Since the tubular passage liner 112 has a straight longitudinal central axis 152 and a straight cylindrical inner passage 138, there is minimal disruption of the combined flow of inlet fluid and bypassed fluid through the tubular passage liner 112.

Figure 8:
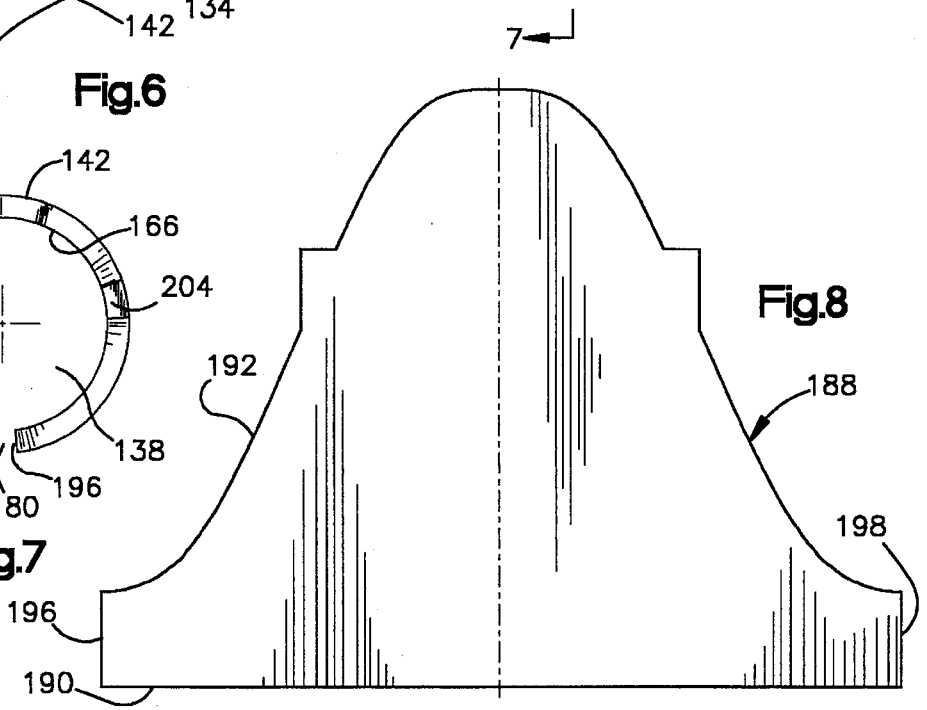
FIG. 8 is an expanded plan view of a metal blank used to form the tubular passage liner of FIG. 4.

The tubular passage liner 112 is formed from a flat steel blank 188 (FIG. 8). The blank 188 has a straight end surface 190 which forms the circular inlet end 130 (FIG. 6) of the tubular passage liner 112. The blank 188 has an edge portion 192 which forms an elliptical outlet edge portion 194 (FIGS. 4, 5 and 6) of the tubular passage liner 112. The blank 188 (FIG. 8) has parallel opposite edge portions 196 and 198 which form opposite sides of the slot 180.

The blank 188 is rolled into the cylindrical configuration of the tubular passage liner 112. The blank 188 is formed of a pre-hardened spring steel which has good erosion resistance properties. However, if desired, the blank 188 could be formed of a mild steel and rolled into the cylindrical configuration of the tubular passage liner 112 and then hardened using a carbon-nitride process.

Installation

The cylindrical tubular passage liner 112 (FIG. 4), has an initial outside diameter which is slightly greater than the inside diameter of the cylindrical surface 144 (FIG. 3) of the inlet passage 104. When the tubular passage liner 112 is to be inserted into the inlet passage 104, a radially inward force is applied against the outer side surface 142 of the tubular passage liner 112 to close the slot 180. Thus, the side surfaces 196 and 198 of the blank 188 (FIG. 8) are moved into abutting engagement with each other by squeezing the outer side surface 142 of the tubular passage liner 112.

When this has been done, the tubular passage liner has an outside diameter which is less than the inside diameter of the cylindrical surface 144 (FIG. 3) of the inlet passage 104. The compressed tubular passage liner 112 is then inserted part way into the inlet passage 104 with the inlet end 130 leading. Once the tubular liner has been inserted part way into the inlet passage 104, the force against the outer side surface of the tubular liner is eliminated. The resilience of the pre-hardened spring steel from which the tubular passage liner 112 is formed causes the passage liner to expand radially outward into tight abutting engagement with the cylindrical side surface 144 of the inlet passage 104.

Figure 3:
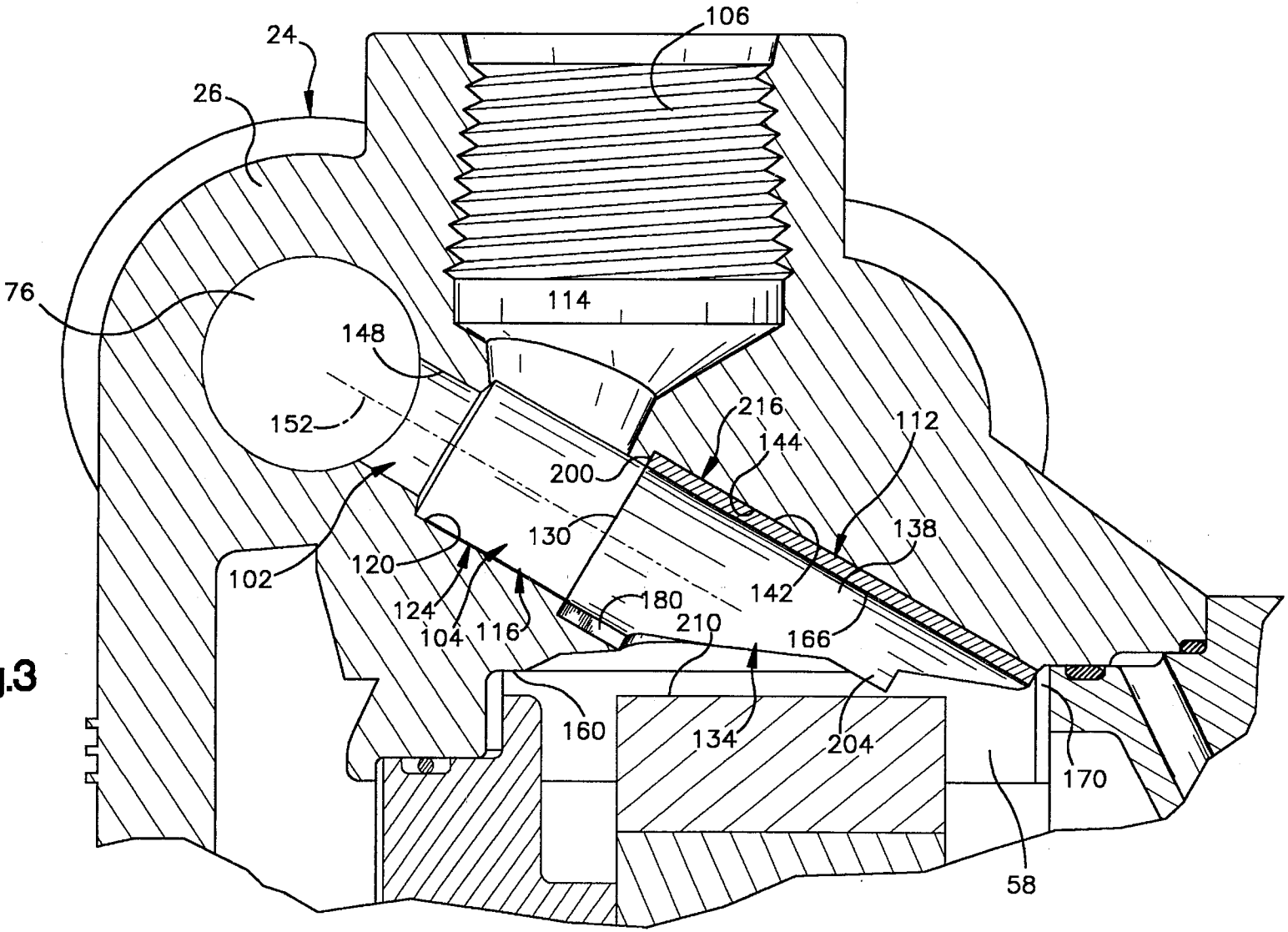
FIG. 3 is an enlarged view of a portion of FIG. 1.

The tubular passage liner 112 is then moved axially into the inlet passage 104 (FIG. 3). Axial movement of the tubular passage liner 112 into the inlet passage 104 continues until the inlet end 130 of the tubular passage liner is in flat abutting engagement with an annular shoulder 200. The annular shoulder 200 extends between the cylindrical side surface 120 and the cylindrical side surface 142 of the inlet passage 104. When this has been done, the elliptical outlet end surface 194 of the passage liner 112 intersects the cylindrical plane of the inlet chamber 58.

The firm grip provided by the resilient spring steel of the tubular passage liner 112 against the cylindrical surface 144 of the inlet passage 104 securely holds the tubular passage liner against axial movement relative to the main section 26 of the pump housing 24. However, it is contemplated that after extended usage of the pump 20, there may possibly be some tendency for the tubular passage liner 112 to move axially along the inlet passage 104. If it occurs, this axial movement of the tubular passage liner 112 would be in a direction away from the bypass valve chamber 76 (FIG. 3) and would be caused by the flow of fluid through the tubular passage liner 112.

When the tubular passage liner 112 is initially installed in the inlet passage 104, as shown in FIG. 3, projections 204 and 206 (FIG. 4) at the outlet end of the tubular passage liner are spaced a small distance from a cylindrical outer side surface 210 (FIG. 1) of the cam ring 38. In the event that there is a slight axial movement of the tubular passage liner 112 in the inlet passage 104, the projections 204 and 206 at the outlet end of the tubular passage liner 112 move into engagement with the cylindrical outer side surface 210 of the cam ring 38. Engagement of the projections 204 and 206 on the tubular passage liner 112 with the cylindrical outer side surface 210 of the cam ring 38 limits axial movement of the tubular passage liner 112 relative to the housing 24.

In the event of axial movement of the tubular passage liner 112 in the inlet passage 104, the projections 204 and 206 (FIG. 4) will locate the tubular passage liner 112 in a position in which the elliptical outlet opening 134 from the passage liner is not blocked by the cam ring 38 (FIG. 1). Thus, the projections 204 and 206 on the tubular passage liner 112 move into engagement with the cylindrical outer side surface 210 on the cam ring 38. The projections 204 and 206 hold the elliptical outlet opening 134 of the tubular passage liner 112 away from the cam ring 210 so that fluid can flow through the tubular passage liner 112.

From the above description of the invention, those skilled in the art will perceive improvements, changes and modifications. Such improvements, changes and modifications within the skill of the art are intended to be covered by the appended claims.

Having described the invention, the following is claimed:

1. A pump assembly comprising:

a housing having an inlet through which fluid is conducted into said housing and an outlet through which fluid is conducted from said housing;

a rotor disposed within said housing;

a stator extending around said rotor and cooperating with said rotor to at least partially define a plurality of pumping chambers, an inlet cavity disposed within said housing and from which fluid is conducted into said pumping chambers;

an inlet passage disposed in said housing for conducting fluid from said inlet to said inlet cavity;

an outlet cavity disposed in said housing to receive fluid from said pumping chambers;

a bypass passage for conducting fluid which flows from said outlet cavity to said inlet passage, and a tubular passage liner at least partially disposed in said inlet passage and having an inlet opening at a first end of said tubular passage liner through which fluid from said bypass passage enters said tubular passage liner and an outlet opening at a second end of said tubular passage liner opposite from said first end and through which fluid flow from said inlet and from said bypass passage is conducted to said inlet cavity, said second end of said tubular passage liner having projections which are engageable with said stator to limit movement of said tubular passage liner relative to said stator.

2. A pump assembly as set forth in claim 1 wherein said inlet cavity is at least partially defined by a side surface area which forms at least a portion of a cylinder, said tubular passage liner having a longitudinal central axis which extends at an angle to the side surface area of said inlet cavity, at least a portion of said second end of said tubular passage liner having an elliptical configuration which corresponds to the elliptical configuration of a junction between the inlet passage and the inlet cavity.

3. A pump assembly as set forth in claim 1 wherein said second end of said tubular passage liner extends at an angle to a longitudinal central axis of said tubular passage liner, said tubular passage liner having a sidewall with a first axially extending side portion which has a first length measured parallel to the longitudinal central axis of said tubular passage liner, said side wall of said tubular passage liner having a second axially extending side portion which is opposite from said first side portion and has a second axial length measured parallel to the longitudinal central axis of said tubular passage liner, said second axial length being less than said first axial length.

4. A pump assembly comprising:

a housing having an inlet through which fluid is conducted into said housing and an outlet through which fluid is conducted from said housing;

a rotor disposed within said housing;

a stator extending around said rotor and cooperating with said rotor to at least partially define a plurality of pumping chambers;

an inlet cavity disposed within said housing and from which fluid is conducted into said pumping chamber;

an inlet passage disposed in said housing for conducting fluid from said inlet to said inlet cavity;

an outlet cavity disposed in said housing to receive fluid from said pumping chambers;

a bypass passage for conducting fluid which flows from said outlet cavity to said inlet passage; and a tubular passage liner at least partially disposed in said inlet passage and having a straight passage which extends axially through said tubular passage liner, said straight passage having an inlet opening at a first end of said tubular passage liner through which fluid from said bypass passage enters said straight passage in said tubular passage liner and an outlet opening at a second end of said tubular passage liner opposite from said first end and from which fluid flow from said inlet and from said bypass passage is conducted to said inlet cavity, said straight passage having a linear longitudinal central axis which is coincident with a linear longitudinal central axis of said tubular passage liner, said second end of said tubular passage liner having projections which are engageable with said stator to position said tubular passage liner relative to said stator.

5. A pump assembly comprising:

a housing having a inlet through which fluid is conducted into said housing and an outlet through which fluid is conducted from said housing;

a rotor disposed within said housing;

a stator extending around said rotor and cooperating with said rotor to at least partially define a plurality of pumping chambers;

an inlet cavity disposed within said housing and from which fluid is conducted into said pumping chambers;

an inlet passage disposed in said housing for conducting fluid from said inlet to said inlet cavity;

an outlet cavity disposed in said housing to receive fluid from said pumping chambers;

a bypass passage for conducting fluid which flows from said outlet cavity to said inlet passage, and a tubular passage liner formed of a resilient metal and at least partially disposed in said inlet passage, said tubular passage liner having an inlet opening at a first end of said tubular passage liner through which fluid from said bypass passage enters said tubular passage liner and an outlet opening at a second end of said tubular passage liner opposite from said first end and from which fluid flow from said inlet and from said bypass passage is conducted to said inlet cavity, said tubular passage liner having an outer side surface which is pressed against an inner side surface of said inlet passage by the resilient metal of said tubular passage liner, said tubular passage liner having an open slot which extends from said first end of said tubular passage liner to said second end of said tubular passage liner to enable said tubular passage liner to resiliently expand in said inlet passage.

6. A pump assembly as set forth in claim 5 wherein said stator has a first end surface which is at least partially disposed in a first plane, a second end surface which is at least partially disposed in a second plane, and a circular outer side surface which extends between said first and second end surfaces, said tubular passage liner extends through at least one of said first and second planes and is at least partially disposed outward of the circular outer side surface of said stator.

7. A pump assembly as set forth in claim 5 wherein said stator has a circular outer side surface, said second end of said tubular passage liner being at least partially disposed radially outward of said circular outer side surface of said stator.

8. A pump assembly as set forth in claim 5 wherein said inlet passage has a first end portion which is connected with said bypass passage and a second end portion which opens into said inlet cavity, said tubular passage liner having a length which is less than a length of said inlet passage.

* * * * *